United States Patent [19]

Jackson et al.

[11] 4,430,809

[45] Feb. 14, 1984

[54] FRONT DRUM ACCESS AND SUPPORT FOR DRYER

[75] Inventors: William A. Jackson, Hartford Township, Van Buren County; Karolis Jautakis, Chikaming Township, Berrien County, both of Mich.

[73] Assignee: Whirlpool Corporation, Benton Harbor, Mich.

[21] Appl. No.: 324,583

[22] Filed: Nov. 24, 1981

[51] Int. Cl.[3] ..... F26B 11/04

[52] U.S. Cl. ..... 34/133; 34/243 R; 432/115

[58] Field of Search ..... 34/133, 243 R, 108, 34/130, 242; 432/242, 103, 115

[56] References Cited

U.S. PATENT DOCUMENTS

| | | | |
|---|---|---|---|
| 2,498,478 | 2/1950 | Balph | 34/68 |
| 2,644,245 | 7/1953 | Hammell et al. | 34/45 |
| 3,033,623 | 5/1962 | Thomson | 308/238 |
| 3,584,393 | 6/1971 | Menk | 34/133 |
| 3,885,840 | 5/1975 | Neder | 308/184 R |
| 4,069,596 | 1/1978 | Sisler | 34/133 |

*Primary Examiner*—Larry I. Schwartz

*Attorney, Agent, or Firm*—Hill, Van Santen, Steadman & Simpson

[57] ABSTRACT

A clothes dryer with a non-circular front access opening is provided with a split ring bearing attached to the dryer drum in a manner to allow for expansion and contraction of the bearing relative to the drum and which rides on a support ring which is attached to and conforms to the access opening, thereby providing a front support for the drum.

15 Claims, 6 Drawing Figures

Fig. 5
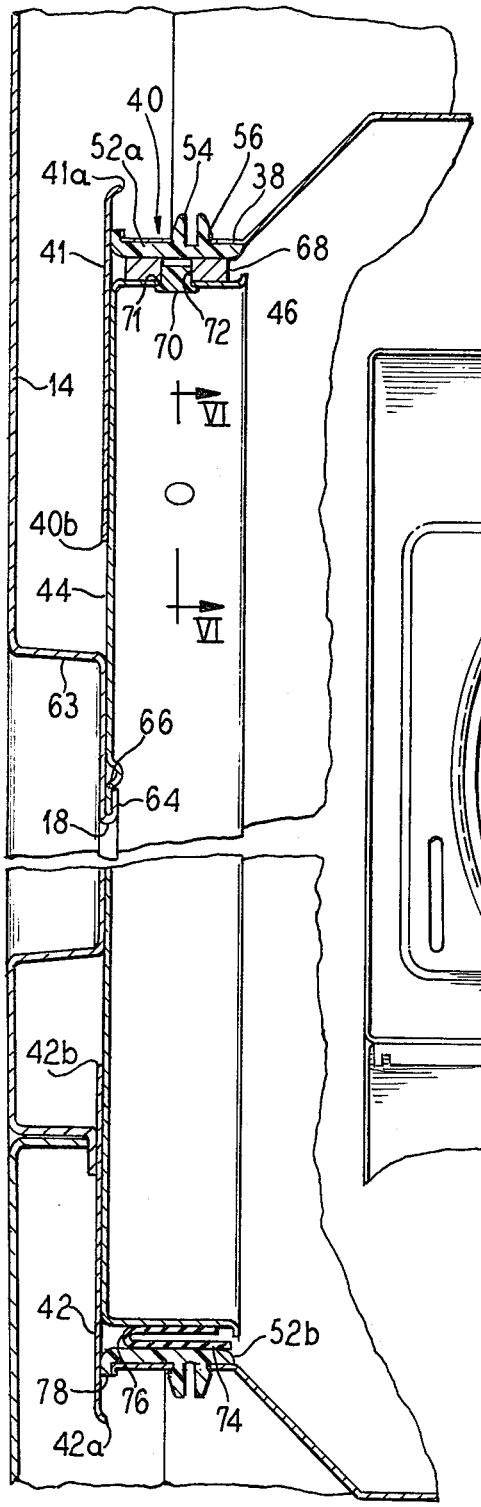
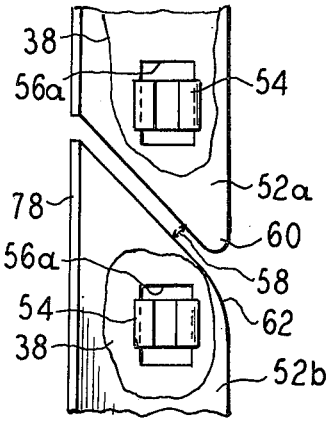
Fig. 4
Fig. 3
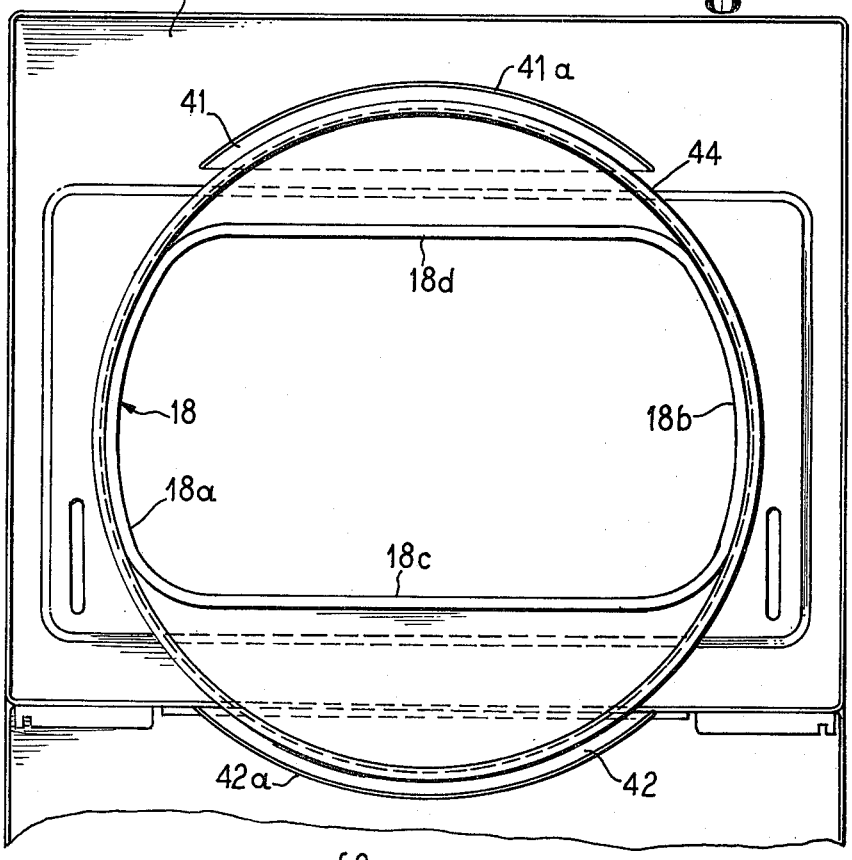
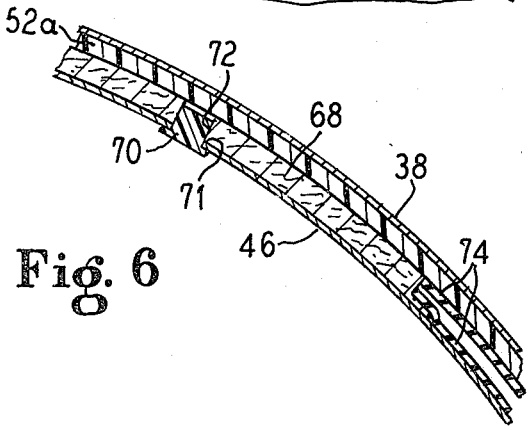
Fig. 6

FRONT DRUM ACCESS AND SUPPORT FOR DRYER

BACKGROUND OF THE INVENTION

1. Field of the Invention

This invention relates to clothes dryers and more particularly to a means of supporting and sealing the drum to the front wall of the dryer so that a non-circular access opening may be provided.

2. Description of the Prior Art

The assignee of this application has in the past provided an access opening through the front wall of a dryer which is circular and which forms a cowl to support the drum on a solid bearing ring. The front wall panel was pierced with a circular opening having a flange extruded inward into the drum cavity. A drum bearing seal assembly was attached to the flange to provide a bearing surface and seal between the two parts as the drum is rotated about the flange.

It has become desirable to provide an access opening through the front wall panel of the dryer which is not circular in shape and which thereby prevents the use of an extruded flange to act as a bearing surface and seal for the rotating drum. U.S. Pat. Nos. 2,498,478; 2,644,245; 3,409,997 and 3,584,393 show dryers which have non-circular access openings with cowl portions extending into the drum. However, the cowl portions do not support the front of the drum but rather a large bearing is provided on the back end of the drum and the drum is mounted in a cantilevered manner such that the rear bearing supports the entire weight of the drum and its contents or else the drum is rotated on rollers engaging the sidewall of the drum.

SUMMARY OF THE INVENTION

In accordance with the present invention, a clothes dryer is provided which has a non-circular access opening in which a front support ring for the dryer drum is adaptable to different shaped front access openings. An outer circumference of the support ring is circular and supports a split ring bearing which is attached to the drum by locking tabs extending from the bearing ring through elongated slots in the drum front rim to allow for expansion and contraction of the bearing relative to the drum and the support ring. In this manner the drum is supported by a front bearing and a rear bearing which allows for smaller bearings and does not result in a cantilevered support thereby reducing the chances of overloading the motor or drive mechanism of the drum. Additionally, a front seal for the drum is provided between the ring bearing and the support ring.

In accordance with the teachings of the present invention, any shape of access opening desired can be chosen as long as it is smaller than the opening in the front of the drum. The stamped support ring has an outer cylindrical surface to provide support for the drum and an inner opening formed in the same shape as the opening in the panel. The support ring is composed of the main support section which has welded thereon two back-up plate sections which maintain a felt bearing and seal assembly in proper axial relationship to the support ring. The support ring is crimped to the front panel around the access opening.

A felt bearing and seal assembly has a thicker bearing portion which is positioned and retained over the top of the support ring and the seal portion is folded over to provide a springing-type seal between the support ring and the drum bearing ring. The drum bearing ring is comprised of two semi-circular molded portions having integral locking tabs. When the two rings are locked inside of the drum shell front they form the drum bearing ring which rides on the support bearing surface while allowing for expansion and contraction of the drum bearing with respect to the drum end. The locking tabs are positioned in slots in the drum such that the tabs can move circumferentially with respect to the drum as the bearing expands and contracts due to the heat of the dryer. A gap in the dryer bearing ring is provided at an angle between the two bearing sections and the ends of the two sections are rounded such that the two sections can ride against the stationary seal and the support bearing without damage thereto even though there is a slight mismatch in assembly or expansion and contraction of the bearings in respect to the drum end.

In assembly, the front panel of the dryer is crimped to the welded support ring and the bearing felt and seal assembly is placed around the cylindrical portion of the support ring. The bearing ring sections are snap fitted into the drum shell front opening and then the front panel with the felt bearing and seal assembly on the support ring is assembled into the drum shell front opening.

BRIEF DESCRIPTION OF THE DRAWINGS

FIG. 3 is a rear elevational view of the dryer with the door removed to show the non-circular opening.

FIG. 4 is a partial view of the ends of the drum bearings and the snap fasteners with the drum mostly cut away.

FIG. 5 is a cross sectional view of the opening in the front panel of the dryer.

FIG. 6 is a partial sectional view taken generally along the lines VI—VI of FIG. 5.

DESCRIPTION OF THE PREFERRED EMBODIMENTS

Figure 1:
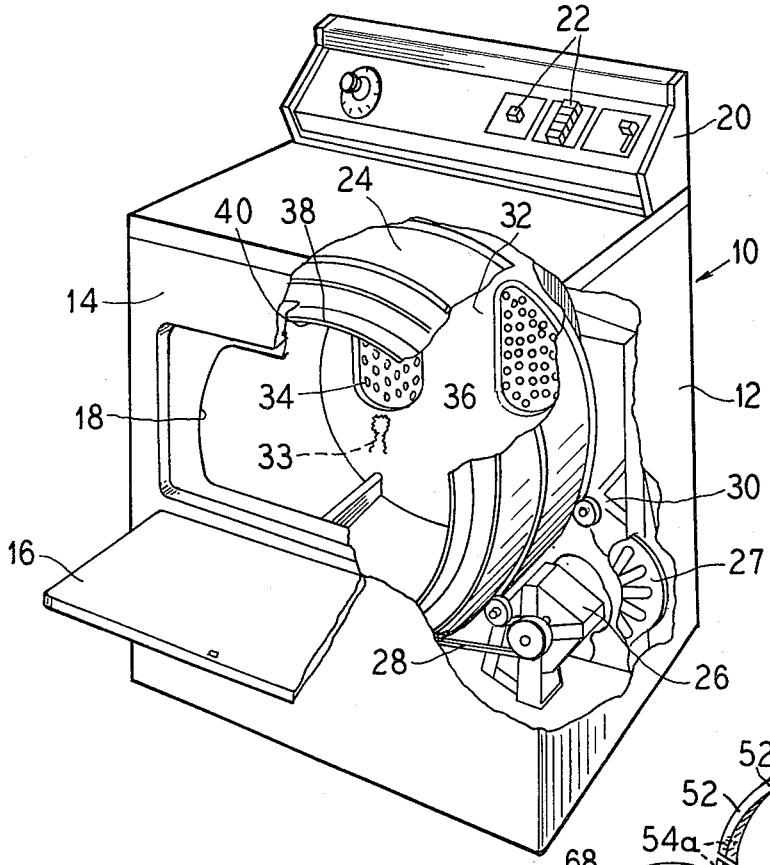
FIG. 1 is a perspective view of a dryer embodying the present invention, partially cut away to show the interior mechanism thereof.

A laundry appliance 10 comprising an automatic clothes dryer embodying the principles of the present invention is depicted in FIG. 1. The dryer is comprised of a cabinet 12 having a front panel 14 with an openable door 16 revealing an access opening 18. A console 20 having presettable controls 22 thereon allows an operator to preselect a program of automatic drying and tumbling in a laundry drying process. The door 16 in the front panel 14 of the cabinet 12 permits access through the access opening 18 into the interior of a drum 24 having open ends which is rotatably mounted within the cabinet 12.

Below the drum 24 but within the cabinet 12 there is provided an electric motor 26 which rotatably drives the drum by means of a belt 28 and also drives a blower 27. A stationary back wall 32 is provided which has within the drum inlet openings 34 and outlet openings 36 for the passage of air circulated by the blower 27 which is used in the drying process. A heater 33 conditions the air before it enters the drum through inlet openings 34. The stationary back wall also has mounted thereon two rollers 30 (only one shown) which support the rear portion of the drum 24, as shown in the aforementioned U.S. Pat. No. 3,409,997.

Figure 2:
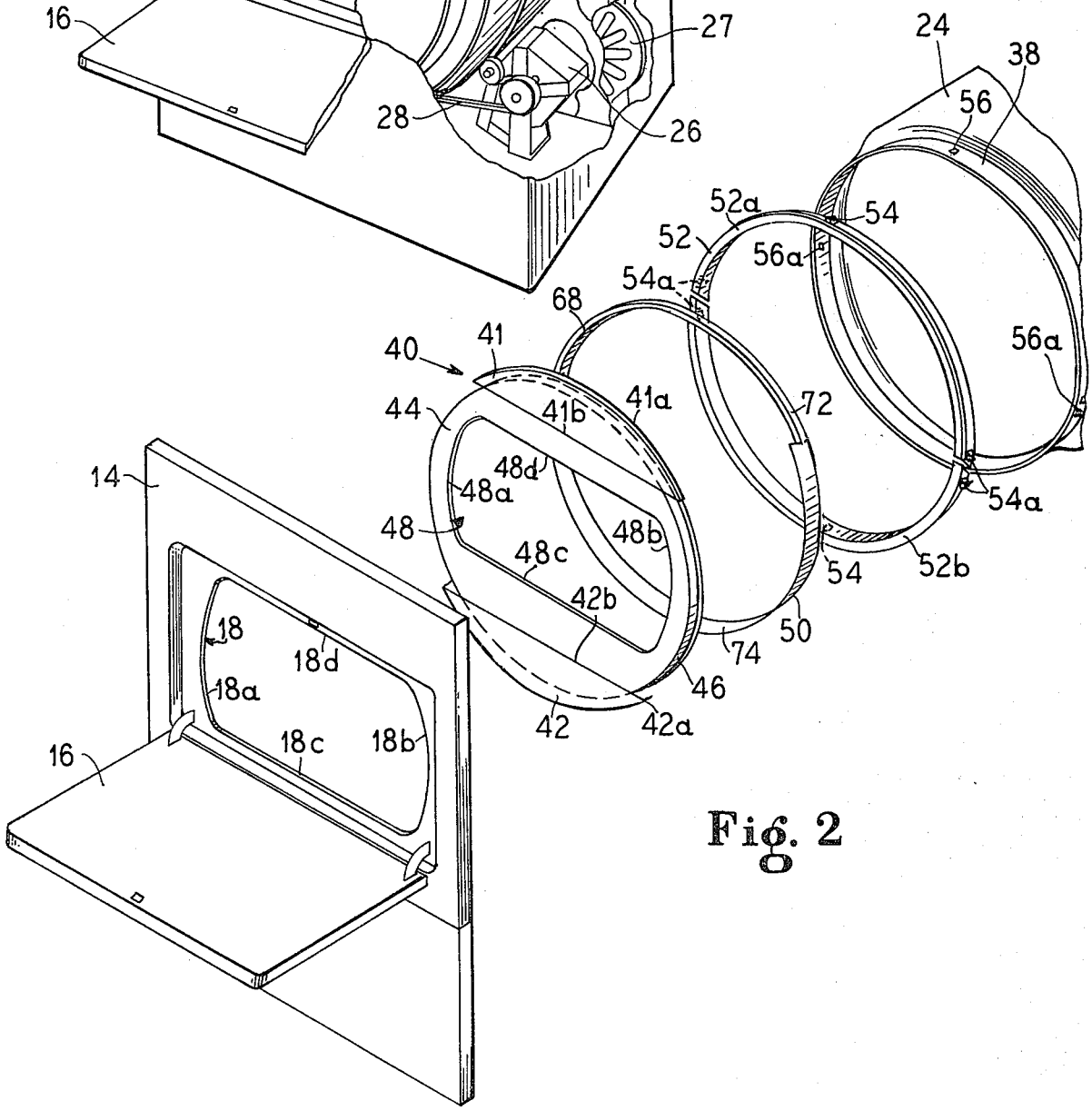
FIG. 2 is an exploded view of the front panel of the dryer and the front bearing pieces and dryer drums.

A front lip or rim 38 of the drum is supported by a bearing means 40 which is shown in greater detail in FIGS. 2 and 5.

FIG. 2 is an exploded view of the front of the dryer 10 in which there is shown the front panel 14 and openable door 16 for controlling access to opening 18. A top back-up plate section 41 and bottom back-up plate section 42 are welded onto a stamped support ring 44 which has an outer cylindrical flange surface 46 to provide support for the drum 24 through rim 38 and an inner opening 48 formed in the same shape as the access opening 18 in the panel 14.

In accordance with the provisions of the present invention it is possible to make the access opening 18 and its counterpart opening 48 in the ring 44 in a non-circular configuration. While any utilitarian desirable geometric shape may be selected, the exemplary shape herein described is more or less rectangular, having its major axis disposed in a horizontal plane, using the orientation of the machine 10. The side edges of the openings 18 and 48 are designated by the suffixes "a" and "b" on opposite sides. The bottom edges are marked with suffixes "c" and are disposed in a generally chordal relation vis-a-vis the pattern of curvature prescribed by the sides 18*a*, 48*a*, 18*b*, 48*b*. The top edges are shown at 18*d* and 48*d* and are similarly disposed in spaced parallel relation to the edges 18*c*, 48*c*.

The top and bottom plate sections 41 and 42 also conveniently take the shape of chordal segments having curved outer edges or rims 41*a* and 42*a* and inner edges 41*b* and 42*b* spaced from and parallel to the correspondingly disposed chordal edges of the opening 48 at 48*c* and 48*d*.

A felt bearing and seal assembly 50 comprises a cylindrical ring-shaped element which is attached to the support ring 44. As seen in FIGS. 2 and 4, a split drum ring bearing 52 having an upper semi-circular portion 52*a* and the lower semi-circular portion 52*b* is provided with central locking tabs 54 and end locking tabs 54*a* which lock into square openings 56 and rectangular openings 56*a*, respectively, in the front lip 38 of the drum 24. When the two semi-circular ring portions 52*a*, 52*b* are locked inside onto the drum shell lip 38, they form the drum bearing ring which rides on the support bearing surface comprising the support ring outer surface 46 and the felt and seal member 50. Square openings 56 locate the upper and lower bearing ring portions 52*a* and 52*b* while rectangular openings 56*a* allow the tabs 54*a* to slide circumferentially. The split nature of the ring and slideable locking tabs 54*a* allow for expansion and contraction of the drum bearing with respect to the drum lip 38.

As seen in FIG. 4, a gap 58 between the drum bearing sections 52*a* and 52*b* is provided at an angle between the two bearing sections and the two section ends are rounded as at 60 and 62 such that the two sections which are attached to the rotating drum can ride against the stationary seal 50 and on the support bearing 44 without damage thereto even though there might be a slight mismatch in assembly or due to expansion and contraction of the bearings 52*a*, 52*b* with respect to the drum lip 38.

As seen in FIG. 5, the front panel 14 has an inward depression therein at 63 forming a well within which the access opening 18 is located. A small flange portion 64 from the front panel 14 is crimped over a lip portion 66 of the support ring 44. In this manner, the support ring 44 is held stationary with respect to the front panel 14 of the dryer 10. The back-up plate sections 41 and 42 provide a stationary axial stop for the bearing and seal.

As seen in FIGS. 5 and 6, the felt bearing and seal member 50 is comprised of a thick bearing portion 68 which is positioned at the top of the support ring 44. The bearing portion 68 is retained in non-rotating position by means of a plurality of small plastic retainers 70 snapped into openings 71 in flange 46 of the support ring 44 and received in openings 72 in the bearing portion of the felt bearing and seal member. The seal portion of the felt bearing and seal member comprises a thinner but wider section 74 which is folded over on itself to form a double thickness as shown at 76 in FIG. 5 to provide a complete air seal between the interior of the drum and the front panel of the dryer. The bearing portion 68 and the seal portion 74 are secured together by appropriate means such as stitching such that the entire felt bearing and seal member 50 remains stationary with respect to the front panel 14 and support ring 44.

The drum bearing ring sections 52*a* and 52*b* are locked inside of the drum shell onto the lip 38 of the front of the drum 24 such that the bearing ring rotates with the drum. A small lip portion 78 is provided at the front end of the bearing ring portions 52*a* and 52*b* which retains the bearing ring in a fixed axial position with respect to the drum 24 and which also provides a riding surface which engages the two backup plate sections 41 and 42 providing additional axial support for the drum 24.

FIG. 3 shows a front plan view of the front panel 14 of the dryer 10 where it is seen that the access opening 18 is of a non-circular shape and also of a size not larger than the circumference of the rim 38 of the drum 24. In accordance with the principles of the present invention, the access opening 18 can be of any size and shape so long as it is not larger than the circumference of the drum 24.

Thus it is seen that the present invention provides for a front drum access of a non-circular shape which still allows for a front bearing means to be provided for the rotating dryer drum thereby permitting the use of a less substantial rear bearing for the drum and also allowing for a stationary rear wall of the dryer drum.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a clothes dryer having a rotatable drum with an inner wall surface forming a front circular opening for receiving clothes to be dried, motor means for driving said drum and a cabinet having a front wall for housing said drum and motor, a drum front support means comprising:

wall means forming a non-circular access opening in said front wall of said cabinet;

a front support ring having a portion connected to and supported by said wall means, said portion conforming to the non-circular shape of said access opening, another portion of said support ring forming a circular bearing surface projecting inwardly of said drum circular opening;

a split bearing ring between said inner surface of said drum circular opening and said bearing surface of said support ring;

tab means for connecting said split bearing ring to said drum inner wall surface, said tab means adapted to allow movement of said ring relative to said drum surface due to heat expansion and contraction of said ring and said drum; and support bearing and seal means mounted between said split bearing and said circular bearing surface for supporting said drum front on said front support ring.

2. In a clothes dryer having a rotatable drum with a front lip forming a front circular opening for receiving clothes to be dried, motor means for driving said drum, a cabinet having a front wall for enclosing said drum and motor and air circulation and heating means for conditioning air to be circulated through said clothes, a drum front support means comprising:

wall means defining an access opening in said front wall of said cabinet;

a front support means having a first portion conforming to the shape of said access opening and a second portion forming a cylindrical bearing surface projecting inwardly of said drum lip means, said first portion secured to and supported by said wall means; and split bearing ring portions between said drum lip and said bearing surface of said support means connected to said drum lip by means adapted to allow for movement of said ring portions relative to said drum lip due to said conditioning of the air flowing through the clothes.

3. The device of claim 2, wherein said front support means comprises a ring-like member and said first portion defines a central opening which is secured to said wall means by crimping said wall means against said support means through said central opening.

4. The device of claim 2, wherein said access opening formed by said wall means is a non-circular shape.

5. The device of claim 2, wherein said split bearing ring portions comprise two semi-circular sections separated by a gap at both ends.

6. The device of claim 5, wherein said split bearing ring portions are further defined by having ends which are rounded.

7. The device of claim 2, wherein said means for connecting said bearing ring to said lip comprises tab means connected to one member received in slots in the other member.

8. The device of claim 7, wherein said tabs are connected to said bearing ring portions.

9. The device of claim 2, further defined by having support bearing and seal means between said split bearing portion and said bearing surface for supporting said drum front on said support means.

10. The device of claim 2, wherein said bearing and seal means is retained in a stationary manner relative to said support means.

11. The device of claim 10, wherein said support bearing and seal means is comprised of a first thick bearing portion and a second thin and wide seal portion which is folded over to form a springing type seal.

12. In a clothers dryer of the type utilizing a rotatable drum with non-rotatable front and rear walls and having a lip forming a front circular opening, the improvement of, a front panel having an access opening and an openable door controlling the opening, a support ring inwardly adjacent to said front panel having an outer circumferentially extending drum support surface for rotatably supporting said drum lip and an opening corresponding in size and shape to said access opening, said access opening and said opening in said support ring being generally rectangular including curved side edges and spaced parallel top and bottom edges, and support bearing and seal means mounted between said drum lip and said support ring.

13. In a clothes dryer as defined in claim 12, top and bottom back-up plate sections on said support ring comprising chordal segments with inner chordal edges spaced from and parallel to the top and bottom edges of said opening for limiting axial movement of said drum toward said front panel.

14. In a clothes dryer as defined in claim 13, said rotatable drum comprising a cylindrical wall having circular front and rear bearing portions, said front bearing portion supported in journal relation by said support ring.

15. In a clothes dryer as defined in claim 14, said support bearing and seal means interposed between said support ring and said drum lip is fabricated of a felt material.

* * * * *